US009013354B2

(12) United States Patent
Huang et al.

(10) Patent No.: US 9,013,354 B2
(45) Date of Patent: Apr. 21, 2015

(54) MULTI-BAND ANTENNA

(71) Applicant: Cheng Uei Precision Industry Co., Ltd., New Taipei (TW)

(72) Inventors: Yi-Feng Huang, New Taipei (TW); Jia-Hung Su, New Taipei (TW); Kai Shih, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 283 days.

(21) Appl. No.: 13/653,403

(22) Filed: Oct. 16, 2012

(65) Prior Publication Data

US 2014/0104115 A1 Apr. 17, 2014

(51) Int. Cl.
*H01Q 9/42* (2006.01)
*H01Q 21/28* (2006.01)

(52) U.S. Cl.
CPC ..... *H01Q 9/42* (2013.01); *H01Q 21/28* (2013.01); *H01Q 5/371* (2015.01)

(58) Field of Classification Search
CPC ..... H01Q 1/38; H01Q 1/48; H01Q 9/0407
USPC ..... 343/700 MS, 702, 725, 893
See application file for complete search history.

(56) References Cited

U.S. PATENT DOCUMENTS

| | | | | |
|---|---|---|---|---|
| 2004/0140941 | A1* | 7/2004 | Joy et al. | 343/795 |
| 2004/0222926 | A1* | 11/2004 | Kontogeorgakis et al. | 343/702 |
| 2008/0246668 | A1* | 10/2008 | Qi et al. | 343/702 |
| 2008/0266202 | A1* | 10/2008 | Lin et al. | 343/893 |
| 2009/0027275 | A1* | 1/2009 | Su et al. | 343/700 MS |
| 2010/0060528 | A1* | 3/2010 | Chiu et al. | 343/700 MS |

* cited by examiner

*Primary Examiner* — Robert Karacsony
*Assistant Examiner* — Daniel J Munoz
(74) *Attorney, Agent, or Firm* — Cheng-Ju Chiang

(57) ABSTRACT

A multi-band antenna includes a substrate and a conductive layer. The conductive layer covered on a top surface of the substrate includes a ground element, a first radiating element and a second radiating element. The ground element is connected with a bottom side edge of the substrate. The first radiating element is connected with one end of a lower top edge of the ground element. The first radiating element includes a connection portion, a first coupling portion, a first radiating portion and a first inductance portion. The second radiating element is connected with the other end of the lower top edge of the ground element. The second radiating element includes a second inductance portion, a second coupling portion, a second radiating portion and a third radiating portion.

13 Claims, 5 Drawing Sheets

| | | |
|---|---|---|
| Mkr1 | 1.565 GHz | 1.8279 |
| Mkr2 | 1.575 GHz | 1.6369 |
| Mkr3 | 1.585 GHz | 1.5574 |

| | | |
|---|---|---|
| Mkr1 | 2.400 GHz | 1.2491 |
| Mkr2 | 2.500 GHz | 1.3033 |
| Mkr3 | 5.100 GHz | 2.0630 |
| Mkr4 | 5.850 GHz | 1.8455 |

| | | | | |
|---|---|---|---|---|
| 1 | 1.565 GHz | 34.025 Ω | -19.405 Ω | 5.2407 pF |
| 2 | 1.575 GHz | 32.991 Ω | -10.955 Ω | 9.2242 pF |
| 3 | 1.585 GHz | 32.116 Ω | -2.2928 Ω | 43.795 pF |

| | | | | |
|---|---|---|---|---|
| 1 | 2.400 GHz | 41.592 Ω | 4.0109 Ω | 265.98 pH |
| 2 | 2.500 GHz | 42.065 Ω | 9.6411 Ω | 613.77 pH |
| 3 | 5.100 GHz | 47.061 Ω | 34.789 Ω | 1.0857 nH |
| 4 | 5.850 GHz | 42.860 Ω | 26.425 Ω | 718.91 pH |

MULTI-BAND ANTENNA

BACKGROUND OF THE INVENTION

1. Field of the Invention

The present invention relates to an antenna, and more particularly to a built-in multi-band antenna adapted for being used in a portable mobile communication device.

2. The Related Art

Nowadays, mobile communication technology has been developed faster and faster, and portable mobile communication devices have been developed towards a multifunctional and miniaturized direction. For example, the portable mobile communication device, such as a cell phone and a notebook, has been developed with a GPS (Global Positioning System) navigation function and a wireless connection function. In order to realize the GPS navigation function and the wireless connection function, the portable mobile communication device need operate in GPS (Global Positioning System) and WIFI (Wireless Fidelity) frequency bands. Accordingly, an antenna for receiving and transmitting GPS signals and another antenna for receiving and transmitting WIFI signals are needed to be used in the portable mobile communication device.

However, when the two antennas are both located in the portable mobile communication device, they will occupy a larger space in the portable mobile communication device that makes the portable mobile communication device have a larger volume, and further increases a manufacture cost of the portable mobile communication device. In order to ensure the portable mobile communication device can operate in GPS (Global Positioning System) and WIFI (Wireless Fidelity) frequency bands, and simultaneously, ensure the portable mobile communication device has a smaller volume, a built-in multi-band antenna with a smaller volume need be designed for receiving and transmitting GPS and WIFI signals.

SUMMARY OF THE INVENTION

An object of the present invention is to provide a multi-band antenna. The multi-band antenna includes a substrate and a conductive layer. The substrate has a bottom side edge, a top side edge parallel to the bottom side edge, a first end edge and a second end edge respectively connected between the bottom side edge and the top side edge. The conductive layer covered on a top surface of the substrate includes a ground element, a first radiating element and a second radiating element. The ground element is connected with the bottom side edge of the substrate and away from the top side edge of the substrate. The ground element has a top edge thereof divided into an upper top edge which is adjacent to the first end edge of the substrate, and a lower top edge which is lower than the upper top edge. The first radiating element is disposed on one end of the top surface of the substrate adjacent to the upper top edge of the ground element, and is connected with one end of the lower top edge of the ground element. The first radiating element includes a connection portion extended upward from the one end of the lower top edge of the ground element, a first coupling portion extended towards the first end edge from an upper portion of a first longitudinal edge of the connection portion facing to the first end edge of the substrate and further stretched over the upper top edge of the ground element, a first radiating portion connected with a distal end of the first coupling portion, and a first inductance portion connected with an upper portion of a second longitudinal edge of the connection portion facing to the second end edge of the substrate. An interspace is remained between the first coupling portion and the ground element for forming a capacitive coupling therebetween, and a slot is remained between an outer periphery of the first radiating portion and an inner periphery of the first inductance portion to form a first simulation inductance therebetween. The second radiating element is disposed on the other end of the top surface of the substrate, and is connected with the other end of the lower top edge of the ground element. The second radiating element includes a second inductance portion extended upward and then extended towards the second end edge of the substrate from the lower top edge of the ground element, a second coupling portion extended upward from a top side edge of a distal end of the second inductance portion, a second radiating portion and a third radiating portion extending towards the second end edge of the substrate from an upper portion and a lower portion of one end edge of the second coupling portion. A space is remained between the second inductance portion and the ground element to form a second simulation inductance therebetween.

As described above, the multi-band antenna assembled in a portable mobile communication device receives and transmits signals with a first frequency range corresponding to global positioning system (GPS) for mobile communication band ranged between 1.565 GHz and 1.585 GHz, a second frequency range corresponding to wireless fidelity (WIFI) communication frequency band ranged between 2.400 GHz and 2.500 GHz, and a third frequency range corresponding to wireless fidelity (WIFI) communication frequency band ranged between 5.100 GHz and 5.850 GHz by means of properly disposing the ground element, the first radiating element and the second radiating element on the substrate. Furthermore, the built-in multi-band antenna occupies a smaller space in the portable mobile communication device for ensuring the portable mobile communication device have a smaller volume so as to lower a manufacture cost of the portable mobile communication device.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
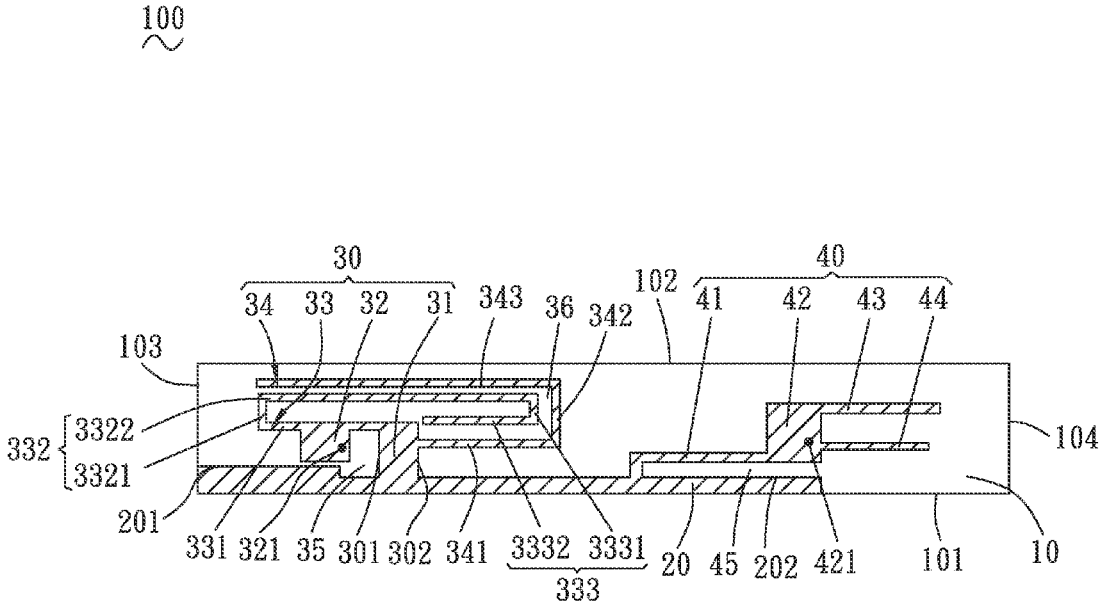
FIG. 1 is a vertical view of a multi-band antenna in accordance with an embodiment of the present invention.

Referring to FIG. 1, a multi-band antenna 100 in accordance with an embodiment of the present invention is shown. The multi-band antenna 100 is formed by pattern etching a copper-plated sheet of synthetic material. The multi-band antenna 100 includes a substrate 10 of synthetic material, and a conductive layer (not labeled) which is a part of the copper-plated sheet. The conductive layer is covered on a top surface of the substrate 10, and includes a ground element 20, a first radiating element 30 and a second radiating element 40. In this embodiment, the substrate 10 is a circuit board.

Referring to FIG. 1, the substrate 10 has a bottom side edge 101, a top side edge 102 parallel to the bottom side edge 101, a first end edge 103 and a second end edge 104 respectively connected between the bottom side edge 101 and the top side edge 102. The ground element 20 is disposed on the top surface of the substrate 10. The ground element 20 is connected with the bottom side edge 101 of the substrate 10 and away from the top side edge 102 of the substrate 10. The ground element 20 is of a stair shape from a vertical view. The ground element 20 has a top edge thereof divided into an upper top edge 201 which is adjacent to the first end edge 103 of the substrate 10, and a lower top edge 202 which is lower than the upper top edge 201. The first radiating element 30 is used for receiving and transmitting lower-frequency band signals. The first radiating element 30 is disposed on one end of the top surface of the substrate 10 adjacent to the upper top edge 201 of the ground element 20, and is connected with one end of the lower top edge 202 of the ground element 20. The first radiating element 30 includes a rectangular connection portion 31, a first coupling portion 32, a first radiating portion 33 and a first inductance portion 34. The connection portion 31 is extended upward from the one end of the lower top edge 202 of the ground element 20, and is spaced from the upper top edge 201 of the ground element 20. The connection portion 31 has a first longitudinal edge 301 and a second longitudinal edge 302 respectively perpendicularly connected with the lower top edge 202. The first longitudinal edge 301 and the second longitudinal edge 302 are spaced from and parallel to each other. The first longitudinal edge 301 faces to the first end edge 103 of the substrate 10 and the second longitudinal edge 302 faces to the second end edge 104 of the substrate 10. The first coupling portion 32 is extended towards the first end edge 103 from an upper portion of the first longitudinal edge 301 of the connection portion 31 facing to the first end edge 103 of the substrate 10 and further stretched over the upper top edge 201 of the ground element 20. A distal end of the first coupling portion 32 is further extended downward to approach to the upper top edge 201 of the ground element 20 so as to make the distal end of the first coupling portion 32 wider than one end of the first coupling portion 32 connected with the connection portion 31 in width. The one end of the first coupling portion 32 is spaced from the lower top edge 202 of the ground element 20. So an interspace 35 is remained between the first coupling portion 32, and the upper top edge 201 and the lower top edge 202 of the ground element 20 for forming a capacitive coupling therebetween to tune resonance frequency and impedance matching characteristic of the multi-band antenna 100. A lower portion of the distal end of the first coupling portion 32 defines a first feed point 321 near to the connection portion 31.

The first radiating portion 33 is connected with the distal end of the first coupling portion 32. The first radiating portion 33 includes an elongated first section 331, an inverted L-shaped second section 332 connected with a distal end of the first section 331, and an inverted L-shaped third section 333 connected with a distal end of the second section 332. The first section 331 is extended towards the first end edge 103 of the substrate 10 from an upper portion of the distal end of the first coupling portion 32. The second section 332 has a short arm 3321 perpendicularly connected with the distal end of the first section 331 and away from the ground element 20, and a long arm 3322 perpendicularly connected with a distal end of the short arm 3321. The long arm 3322 of the second section 332 is parallel to and apart faces to the first section 331, the first coupling portion 32 and the connection portion 31 with a distal end thereof being further beyond the connection portion 31. The third section 333 has a short strip 3331 perpendicularly connected with the distal end of the long arm 3322 of the second section 332 and facing to the short arm 3321 of the second section 332, and a long strip 3332 perpendicularly connected with a distal end of the short strip 3331. The long strip 3332 of the third section 333 is extended towards the connection portion 31 to approach to the second longitudinal edge 302, and apart parallel to the long arm 3322 of the second section 332.

The first inductance portion 34 connected with an upper portion of the second longitudinal edge 302 of the connection portion 31 facing to the second end edge 104 of the substrate 10 includes a first bar 341 extended opposite to the first coupling portion 32 from the upper portion of the second longitudinal edge 302 of the connection portion 31, a second bar 342 perpendicularly connected with a distal end of the first bar 341 and extended opposite to the ground element 20, and a third bar 343 perpendicularly connected with a distal end of the second bar 342 and extended towards the first end edge 103 of the substrate 10. The first bar 341 is located between the ground element 20 and the long strip 3332 of the second section 332, and is extended beyond the first radiating portion 33. The first bar 341 is respectively parallel to and spaced from the ground element 20 and the long strip 3332 of the second section 332. The second bar 342 faces to the short strip 3331 of the third section 333, and is extended beyond the third section 333. The second bar 342 is parallel to and spaced from the short strip 3331 of the third section 333. The third bar 343 faces to the long arm 3322 of the second section 332. The long arm 3322 of the second section 332 is parallel to and spaced from the long arm 3322 of the second section 332. So that the first inductance portion 34 substantially surrounds the first radiating portion 33 with the first bar 341 being apart parallel to the lower top edge 202 of the ground element 20. A slot 36 is remained between an outer periphery of the first radiating portion 33 and an inner periphery of the first inductance portion 34 to form a first simulation inductance therebetween for tuning bandwidth and input impedance of the multi-band antenna 100 to realize impedance matching characteristic of the multi-band antenna 100. So that return loss is reduced, and receiving and transmitting performance of the multi-band antenna 100 at lower-frequency band signals is improved.

Referring to FIG. 1, the second radiating element 40 is used for receiving and transmitting higher-frequency band signals. The second radiating element 40 is disposed on the other end of the top surface of the substrate 10 and is connected with the other end of the lower top edge 202 of the ground element 20. The second radiating element 40 includes a second inductance portion 41, a second coupling portion 42, a second radiating portion 43 and a third radiating portion 44. The second inductance portion 41 is extended upward along a short distance and then extended towards the second end edge 104 of the substrate 10 from the lower top edge 202 of the ground element 20. A space 45 is remained between the second inductance portion 41 and the ground element 20 to form a second simulation inductance therebetween for tuning bandwidth and input impedance of the multi-band antenna 100 to realize impedance matching characteristic of the multi-band antenna 100. So that return loss is reduced, and receiving and transmitting performance of the multi-band antenna 100 at higher-frequency band signals is improved. A distal end surface of the second inductance portion 41 is in alignment with an end surface of the ground element 20 facing to the second end edge 104. The second coupling portion 42 is perpendicularly extended upward from a top side edge of the distal end of the second inductance portion 41. One end face of the second coupling portion 42 facing to the second end edge 104 is in alignment with the end surface of the ground element 20 facing to the second end edge 104. A lower portion of the second coupling portion 42 defines a second feed point 421 near to the third radiating portion 44. The second radiating portion 43 and the third radiating portion 44 are extended towards the second end edge 104 of the substrate 10 from an upper portion and a lower portion of the one end face of the second coupling portion 42. The second radiating portion 43 and the third radiating portion 44 are apart parallel to each other, and are extended beyond the ground element 20 to further parallel to the bottom side edge 101 of the substrate 10.

Preferably, the conductive layer together with the top surface of the substrate 10 is coated with black paint to protect the conductive layer of the multi-band antenna 100.

When the multi-band antenna 100 is used in global positioning system (GPS) for mobile communication, the multi-band antenna 100 disposed on the substrate 10 is assembled in a portable mobile communication device (not shown) and an electric current is fed into the built-in multi-band antenna 100 by the first feed point 321. The first radiating portion 33 of the first radiating element 30 resonates at a first frequency range covering 1.565 GHz to 1.585 GHz. When the built-in multi-band antenna 100 is used in wireless fidelity communication, the multi-band antenna 100 disposed on the substrate 10 is assembled in the portable mobile communication device (not shown) and another electric current is fed into the built-in multi-band antenna 100 by the second feed point 421. The second radiating portion 43 of the second radiating element 40 resonates at a second frequency range covering 2.400 GHz to 2.500 GHz, and the third radiating portion 44 of the second radiating element 40 resonates at a third frequency range covering 5.100 GHz to 5.850 GHz. Therefore, the built-in multi-band antenna 100 obtains the first frequency range corresponding to global positioning system (GPS) for mobile communication band ranged between 1.565 GHz and 1.585 GHz, the second frequency range corresponding to wireless fidelity (WIFI) communication frequency band ranged between 2.400 GHz and 2.500 GHz, and the third frequency range corresponding to wireless fidelity (WIFI) communication frequency band ranged between 5.100 GHz and 5.850 GHz. So the built-in multi-band antenna 100 obtains the frequency range corresponding to the above-mentioned multiple bands.

Figure 2:
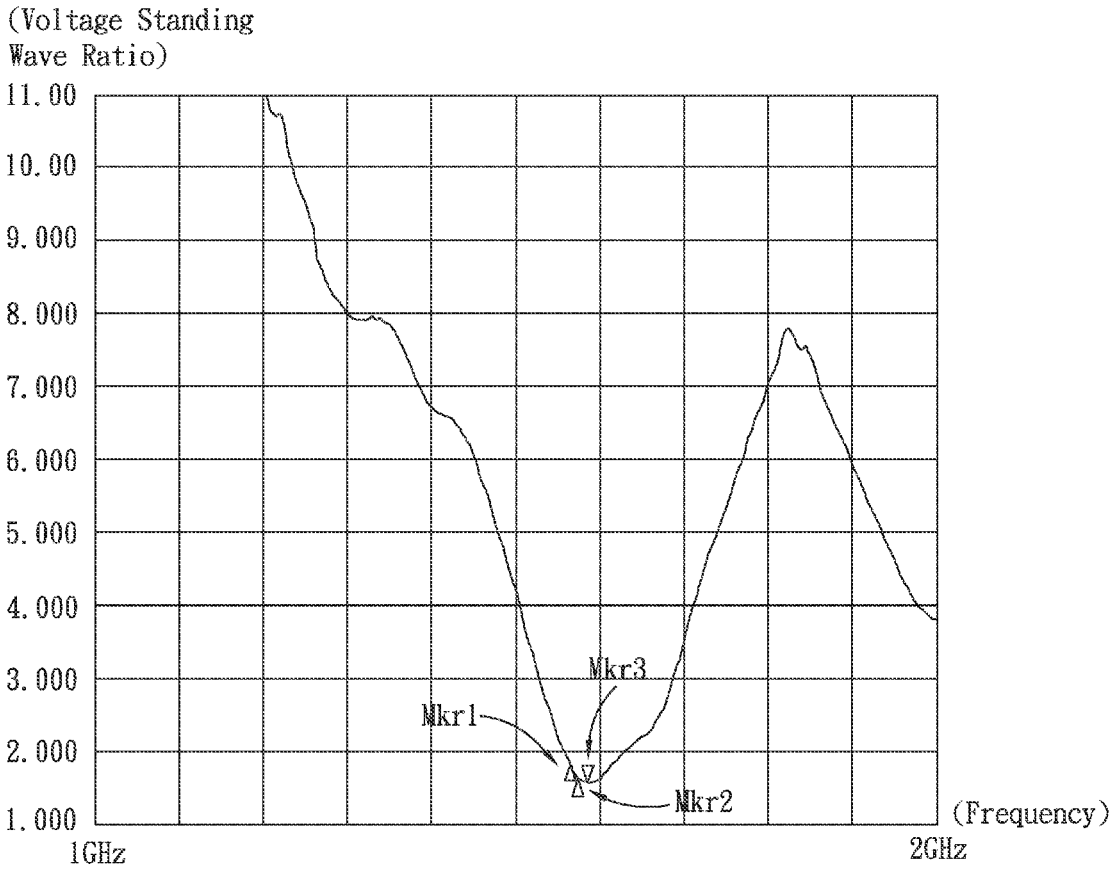
FIG. 2 is a test chart of voltage standing wave ratio of the multi-band antenna of FIG. 1.

Please refer to FIG. 1 and FIG. 2, which show a Voltage Standing Wave Ratio (VSWR) test chart of the multi-band antenna 100 when the multi-band antenna 100 operates at global positioning system (GPS) for mobile communication. When the multi-band antenna 100 operates at a frequency of 1.565 GHz (indicator Mkr1 in FIG. 2), the resulting VSWR value is 1.8279. When the multi-band antenna 100 operates at a frequency of 1.575 GHz (indicator Mkr2 in FIG. 2), the resulting VSWR value is 1.6369. When the multi-band antenna 100 operates at a frequency of 1.585 GHz (indicator Mkr3 in FIG. 2), the resulting VSWR value is 1.5574. Consequently, the VSWR values of the multi-band antenna 100 are all less than 2, which means that the multi-band antenna 100 has an excellent frequency response between 1.565 GHz and 1.585 GHz.

Figure 3:
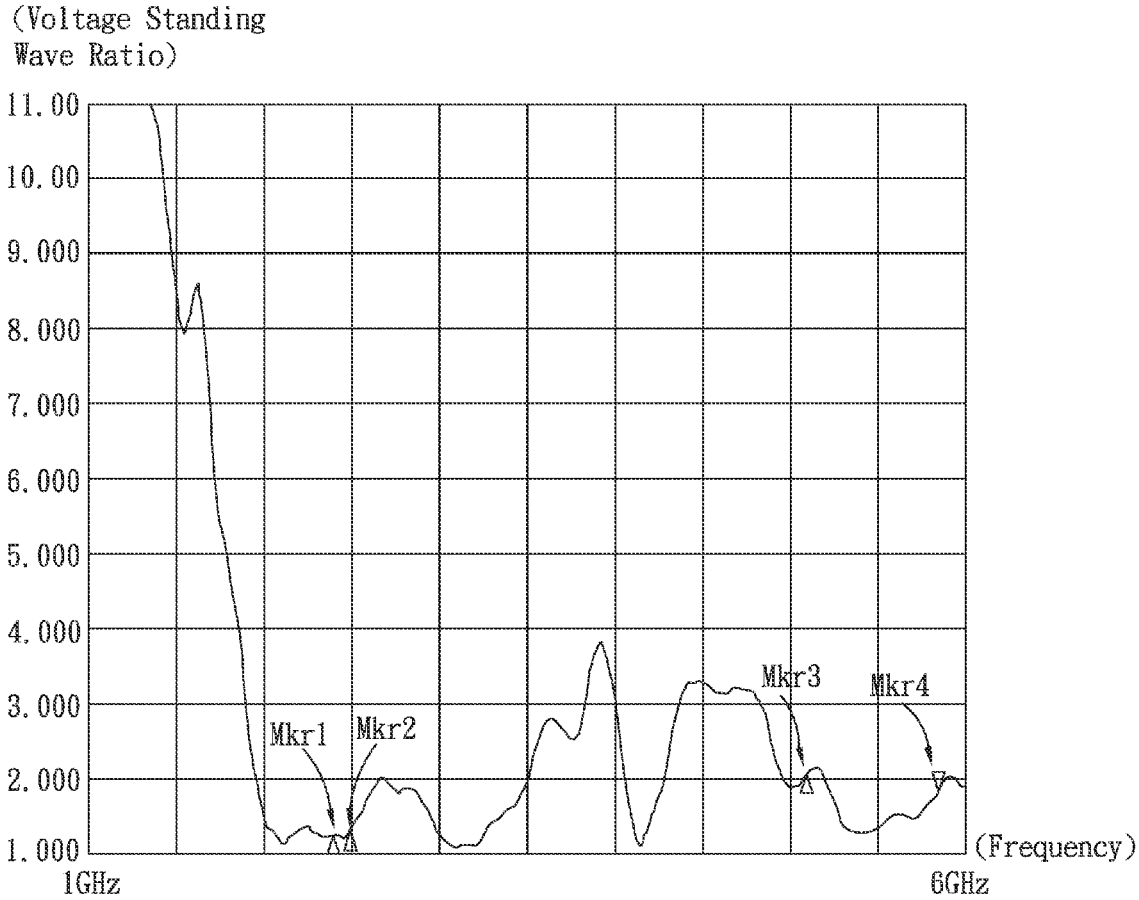
FIG. 3 is another test chart of voltage standing wave ratio of the multi-band antenna of FIG. 1.

Please refer to FIG. 1 and FIG. 3, which show a Voltage Standing Wave Ratio (VSWR) test chart of the multi-band antenna 100 when the multi-band antenna 100 operates at wireless fidelity (WIFI) communication. When the multi-band antenna 100 operates at a frequency of 2.400 GHz (indicator Mkr1 in FIG. 3), the resulting VSWR value is 1.2491. When the multi-band antenna 100 operates at a frequency of 2.500 GHz (indicator Mkr2 in FIG. 3), the resulting VSWR value is 1.3033. When the multi-band antenna 100 operates at a frequency of 5.100 GHz (indicator Mkr3 in FIG. 3), the resulting VSWR value is 2.0630. When the multi-band antenna 100 operates at a frequency of 5.850 GHz (indicator Mkr4 in FIG. 3), the resulting VSWR value is 1.8455. Consequently, the VSWR values of the multi-band antenna 100 are all close to 2, which means that the multi-band antenna 100 has an excellent frequency response between 2.400 GHz and 2.500 GHz, and between 5.100 GHz and 5.850 GHz as well.

Figure 4:
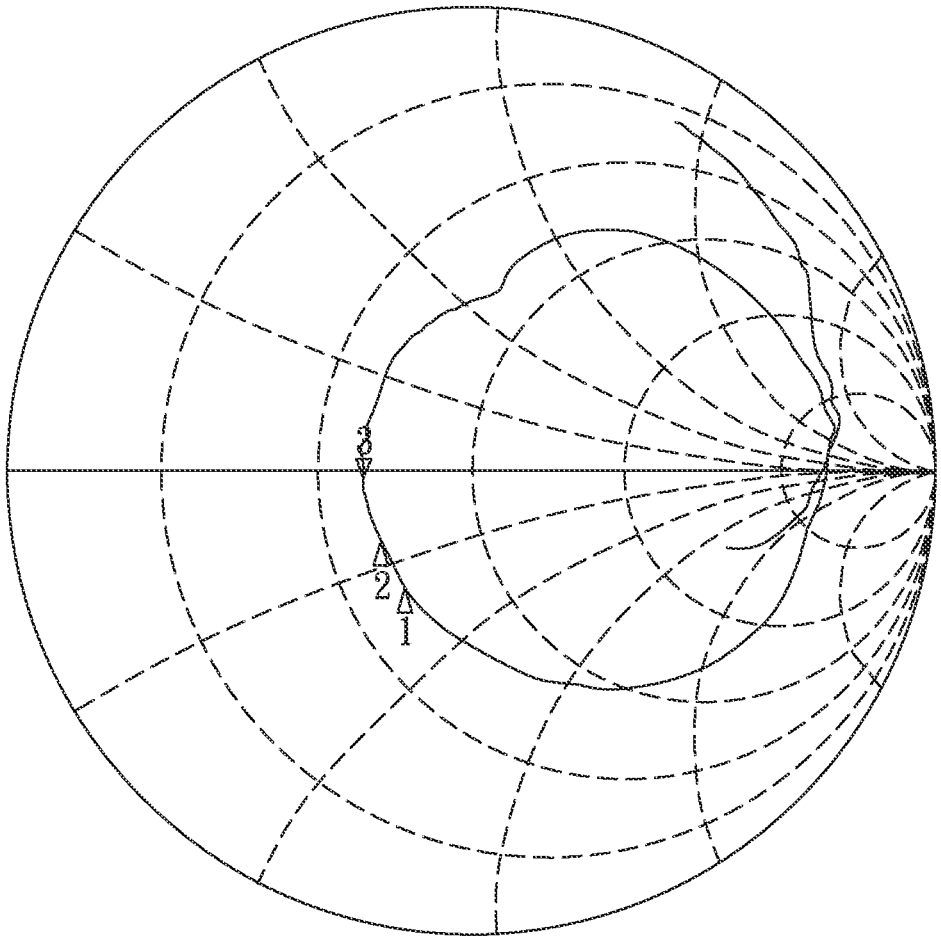
FIG. 4 is a feed Smith chart of the multi-band antenna of FIG. 1.

Please refer to FIG. 1 and FIG. 4, which show a Smith chart recording impedance of the multi-band antenna 100 when the multi-band antenna 100 operates at wireless fidelity (WIFI) communication. The multi-band antenna 100 exhibits an impedance of (34.025-j19.405) Ohm at 1.565 GHz (indicator 1 in FIG. 5), an impedance of (32.991-j10.955) Ohm at 1.575 GHz (indicator 2 in FIG. 5), and an impedance of (32.116-j2.2928) Ohm at 1.585 GHz (indicator 3 in FIG. 5). Therefore, the multi-band antenna 100 has good impedance characteristic.

Figure 5:
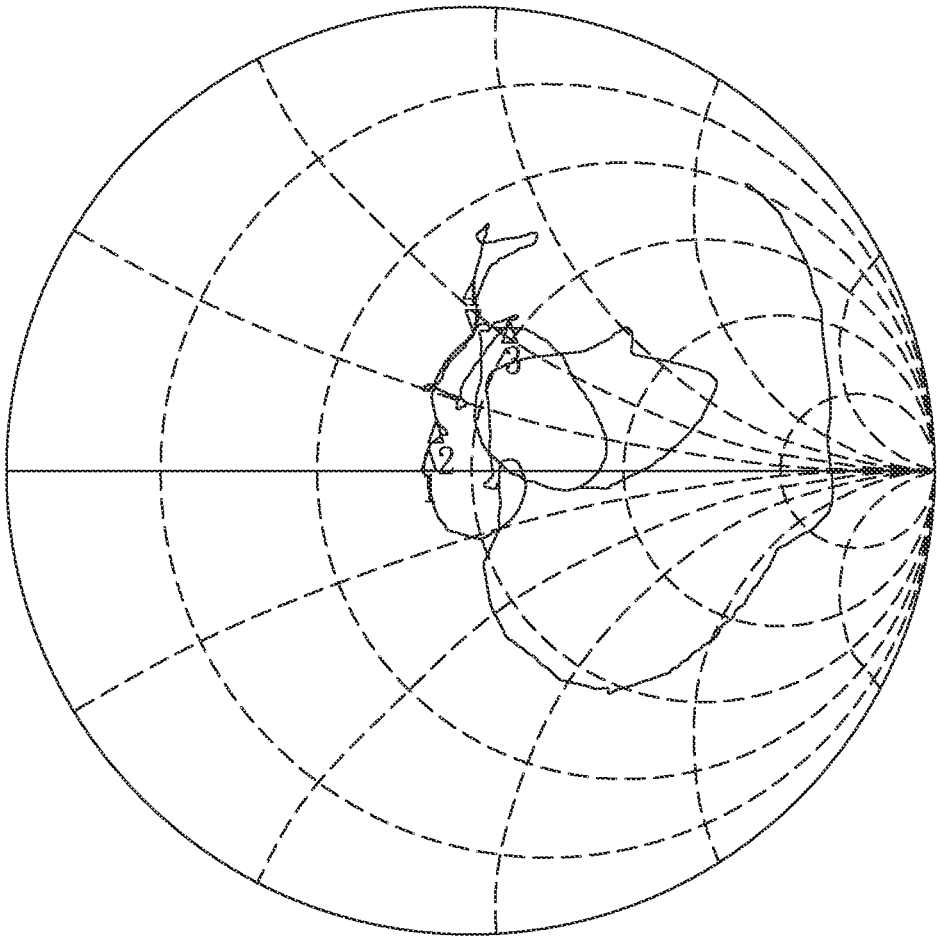
FIG. 5 is another feed Smith chart of the multi-band antenna of FIG. 1.

Please refer to FIG. 1 and FIG. 5, which show a Smith chart recording impedance of the multi-band antenna 100 when the multi-band antenna 100 operates at global positioning system (GPS) for mobile communication. The multi-band antenna 100 exhibits an impedance of (41.592+j4.0109) Ohm at 2.400 GHz (indicator 1 in FIG. 4), an impedance of (42.065+j9.6411) Ohm at 2.500 GHz (indicator 2 in FIG. 4), an impedance of (47.061+j34.789) Ohm at 5.100 GHz (indicator 3 in FIG. 4), and an impedance of (42.860+j26.425) Ohm at 5.85 GHz (indicator 4 in FIG. 4). Therefore, the multi-band antenna 100 has good impedance characteristic.

As described above, the multi-band antenna 100 assembled in the portable mobile communication device receives and transmits signals with the first frequency range corresponding to global positioning system (GPS) for mobile communication band ranged between 1.565 GHz and 1.585 GHz, the second frequency range corresponding to wireless fidelity (WIFI) communication frequency band ranged between 2.400 GHz and 2.500 GHz, and the third frequency range corresponding to wireless fidelity (WIFI) communication frequency band ranged between 5.100 GHz and 5.850 GHz by means of properly disposing the ground element 20, the first radiating element 30 and the second radiating element 40 on the substrate 10. Furthermore, the built-in multi-band antenna 100 occupies a smaller space in the portable mobile communication device for ensuring the portable mobile communication device have a smaller volume so as to lower a manufacture cost of the portable mobile communication device.

What is claimed is:

1. A multi-band antenna, comprising:

a substrate having a bottom side edge, a top side edge parallel to the bottom side edge, a first end edge and a second end edge respectively connected between the bottom side edge and the top side edge; and a conductive layer covered on a top surface of the substrate, comprising:

a ground element connected with the bottom side edge of the substrate and away from the top side edge of the substrate, the ground element having a top edge thereof divided into an upper top edge which is adjacent to the first end edge of the substrate, and a lower top edge which is lower than the upper top edge;

a first radiating element disposed on one end of the top surface of the substrate adjacent to the upper top edge of the ground element, and connected with one end of the lower top edge of the ground element, the first radiating element including a connection portion extended upward from the one end of the lower top edge of the ground element, a first coupling portion extended towards the first end edge from an upper portion of a first longitudinal edge of the connection portion facing to the first end edge of the substrate and further stretched over the upper top edge of the ground element, a first radiating portion connected with a distal end of the first coupling portion, and a first inductance portion connected with an upper portion of a second longitudinal edge of the connection portion facing to the second end edge of the substrate, an interspace being remained between the first coupling portion and the ground element for forming a capacitive coupling therebetween, and a slot being remained between an outer periphery of the first radiating portion and an inner periphery of the first inductance portion to form a first simulation inductance therebetween, wherein the first inductance portion includes a first bar extended opposite to the first coupling portion from the upper portion of the second longitudinal edge of the connection portion, a second bar perpendicularly connected with a distal end of the first bar and extended opposite to the ground element, and a third bar perpendicularly connected with a distal end of the second bar and extended towards the first end edge of the substrate, the first inductance portion substantially surrounds the first radiating portion with the first bar being apart parallel to the lower top edge of the ground element; and a second radiating element disposed on the other end of the top surface of the substrate, and connected with the other end of the lower top edge of the ground element, the second radiating element including a second inductance portion extended upward and then extended towards the second end edge of the substrate from the lower top edge of the ground element, a second coupling portion extended upward from a top side edge of a distal end of the second inductance portion, a second radiating portion and a third radiating portion extended towards the second end edge of the substrate from an upper portion and a lower portion of one end edge of the second coupling portion, a space being remained between the second inductance portion and the ground element to form a second simulation inductance therebetween.

2. The multi-band antenna as claimed in claim 1, wherein the first radiating portion includes an elongated first section extended towards the first end edge of the substrate from an upper portion of the distal end of the first coupling portion, an inverted L-shaped second section connected with a distal end of the first section, and an inverted L-shaped third section connected with a distal end of the second section.

3. The multi-band antenna as claimed in claim 2, wherein the second section has a short arm perpendicularly connected with the distal end of the first section and away from the ground element, and a long arm perpendicularly connected with a distal end of the short arm, the long arm of the second section is parallel to and apart faces to the first section, the first coupling portion and the connection portion with a distal end thereof being further beyond the connection portion.

4. The multi-band antenna as claimed in claim 3, wherein the third section has a short strip perpendicularly connected with the distal end of the long arm of the second section and facing to the short arm of the second section, and a long strip perpendicularly connected with a distal end of the short strip, the long strip of the third section is extended towards the connection portion to approach to the second longitudinal edge, and apart parallel to the long arm of the second section.

5. The multi-band antenna as claimed in claim 1, wherein the distal end of the first coupling portion is further extended downward to approach to the upper top edge of the ground element so as to make the distal end of the first coupling portion wider than one end of the first coupling portion connected with the connection portion in width, the one end of the first coupling portion is spaced from the lower top edge of the ground element, the interspace is remained between the first coupling portion, and the upper top edge and the lower top edge of the ground element.

6. The multi-band antenna as claimed in claim 5, wherein a lower portion of the distal end of the first coupling portion defines a first feed point near to the connection portion.

7. The multi-band antenna as claimed in claim 1, wherein the second radiating portion and the third radiating portion are apart parallel to each other and are extended beyond the ground element to further parallel to the bottom side edge of the substrate.

8. The multi-band antenna as claimed in claim 1, wherein a lower portion of the second coupling portion defines a second feed point near to the third radiating portion.

9. The multi-band antenna as claimed in claim 1, wherein the first radiating portion of the first radiating element resonates at a first frequency range covering 1.565 GHz to 1.585 GHz, the second radiating portion of the second radiating element resonates at a second frequency range covering 2.400 GHz to 2.500 GHz, and the third radiating portion of the second radiating element resonates at a third frequency range covering 5.100 GHz to 5.850 GHz.

10. The multi-band antenna as claimed in claim 1, wherein the conductive layer together with the top surface of the substrate is coated with black paint to protect the conductive layer of the multi-band antenna.

11. The multi-band antenna as claimed in claim 1, wherein the multi-band antenna is formed by pattern etching a copper-plated sheet of synthetic material.

12. The multi-band antenna as claimed in claim 11, wherein the conductive layer is a part of the copper-plated sheet.

13. The multi-band antenna as claimed in claim 11, wherein the substrate of synthetic material is a circuit board.

* * * * *